US005595304A

United States Patent [19]

Timmins

[11] Patent Number: 5,595,304

[45] Date of Patent: Jan. 21, 1997

[54] SHIPPING CONTAINER

[75] Inventor: Lawrence J. Timmins, Riverview, Mich.

[73] Assignee: Chrysler Corporation, Auburn Hills, Mich.

[21] Appl. No.: 468,696

[22] Filed: Jun. 6, 1995

[51] Int. Cl.[6] ..... B65D 19/20

[52] U.S. Cl. ..... 206/598; 206/596; 206/600; 206/746

[58] Field of Search ..... 206/386, 596, 206/598, 600, 595, 45.12, 45.19, 746

[56] References Cited

U.S. PATENT DOCUMENTS

| | | | |
|---|---|---|---|
| 3,442,434 | 5/1969 | De Simas | 206/598 X |
| 3,653,495 | 4/1972 | Gray | 206/45.12 |
| 3,730,417 | 5/1973 | Lawson | 206/596 X |
| 3,995,736 | 12/1976 | Lawson et al. | 206/386 |
| 4,085,847 | 4/1978 | Jacalone | 206/600 |

FOREIGN PATENT DOCUMENTS

| | | | |
|---|---|---|---|
| 2101897 | 6/1979 | Germany | 206/386 |
| 3500427 | 7/1986 | Germany | 206/386 |
| 2085838 | 5/1982 | United Kingdom | 206/598 |

*Primary Examiner*—Bryon P. Gehman
*Attorney, Agent, or Firm*—Edward A. Craig

[57] ABSTRACT

A shipping container having a relatively conventional rectangular shape is provided fabricated of multi-ply corrugated cardboard. A pallet is provided within the container. The pallet is supported by the bottom wall of the container. The pallet is also fabricated from multi-ply corrugated cardboard. A portion of one of the container side walls and an attached closure flap are provided with substantially parallel discontinuace slits which extend from and edge of the closure flap to a point substantially midway of the side wall. Tab portions are provided along the length of each slit. The tabs may be torn to separate the material between the slits and provide an opening which permits ready access to articles in the lower portion of the container.

4 Claims, 3 Drawing Sheets

SHIPPING CONTAINER

BACKGROUND OF THE INVENTION

1. Field of the Invention

The present invention relates to a shipping container fabricated of multi-ply corrugated cardboard. A pallet is provided within the container supported by the bottom wall of the container.

2. Description of the Prior Art

Shipping containers of the heavy duty type used for transporting articles used in manufacturing processes have commonly been fabricated of either metal, plastic or wood in order to withstand the forces exerted by the heavy objects shipped in such containers. The use of such materials to fabricate containers has several disadvantages. For one, metal, wood and plastic are relatively expensive resulting in high container costs. Additionally, these materials are somewhat heavy, thereby causing increased transportation costs, transportation of containers frequently being cost-assessed in terms of weight. Also, such prior art containers are of the returnable type and must be shipped back to the manufacturing source after each use. While returnable containers are desirable in many applications, there are also many applications wherein it is not desired to have returnable containers.

Containers have also commonly been fabricated of corrugated cardboard. Such containers are useful for many purposes, particularly when relatively light-weight objects are to be transported. Corrugated cardboard has the advantage of being easily fabricated into box-like containers. Further, cardboard is disposable, resulting in the lack of a need to return the containers to the manufacturing source. The containers may be disposed of by recycling processes which are considered to be environmentally desirable. Cardboard is also an inexpensive material and is relatively lightweight, thus reducing shipping costs.

The use of cardboard for fabricating shipping containers has had a weight limitation. As the weight of the contents of such containers has increased, a point is reached where cardboard has not been structurally strong enough to hold up and its use has been substituted for by the conventional wood, metal or plastic containers. In accordance with the present invention, multi-ply corrugated cardboard has been employed to fabricate shipping containers for carrying heavy-weight materials. A triple-ply cardboard has been found to be a preferred material for fabricating the container. Containers of this construction have been able to withstand loads of, for example, 1,100 pounds. In addition to the use of cardboard to fabricate the container, the provision of conventional wood pallets to lift and transport the containers has also been eliminated. A pallet, also fabricated of multi-ply corrugated cardboard, has been developed. The pallet is placed within the container and rests on the bottom wall of the container to result in an integrated total package. Objects are loaded into the container and directly supported by the pallet construction.

SUMMARY OF THE INVENTION

The shipping container is broadly of conventional construction, comprising a generally rectangular bottom wall having four edges. A side wall extends upwardly from each edge. Adjacent ones of the side walls are connected to each other. Each side wall has an upper edge. A closure flap is hingedly connected to the upper edge of each side wall. The flaps are foldable inwardly of the container to form a top closure and are foldable outwardly of the container to permit access to the container interior.

The improved container is fabricated of multi-ply corrugated cardboard. Preferably, the corrugated cardboard is triple-ply material.

A pallet is provided within a container supported by the bottom container wall. The pallet includes an article carrying panel having an upper surface for supporting articles received in the container and a lower surface. The lower surface has at least three spaced-apart elongated support members secured thereto and extending thereacross to thereby space the article carrying panel from the container bottom wall.

The support members define a pair of elongated slots to receive the tines of a forklift truck for lifting the pallet. At least one of the container side walls has a pair of spaced-apart openings adjacent the bottom wall of the container in line with the pallet slots to permit insertion of the tines of a forklift truck into the pallet slots.

The pallet is preferably adhered to the bottom wall of the container. Preferably, each elongated support member of the pallet comprises a plurality of strips of corrugated cardboard adhered together and to the lower surface of the article carrying panel.

Each of the closure flaps has an unattached edge. At least one of the side walls and its hingedly connected flap have a pair of spaced-apart discontinuace slits formed therein. These slits extend from the unattached edge of the flap to a point substantially midway of the side wall to which the flap is connected. The discontinuity of the slits is created by spaced-apart unslitted tab portions along the lengths thereof. The corrugated cardboard portion between the slits is manually separable from the remaining portions of the respective side wall and closure flap by pulling thereon to tear the tab portions and thereby permit ready access to articles in the lower portion of the container. The side wall having the slits is preferably scored to create grooves in at least two places between the slits. One of the grooves extends between the lower end points of the slits and the other groove extends between the slits at a position spaced upwardly from the lower slit. The grooves facilitate manual downward bending of any corrugated cardboard portion which is separated from the remaining portions of the respective side wall and closure flap to get it out of the way and facilitate access to the container interior. Two grooves are provided to accommodate people of different heights.

DETAILED DESCRIPTION OF A PREFERRED EMBODIMENT

Figure 1:
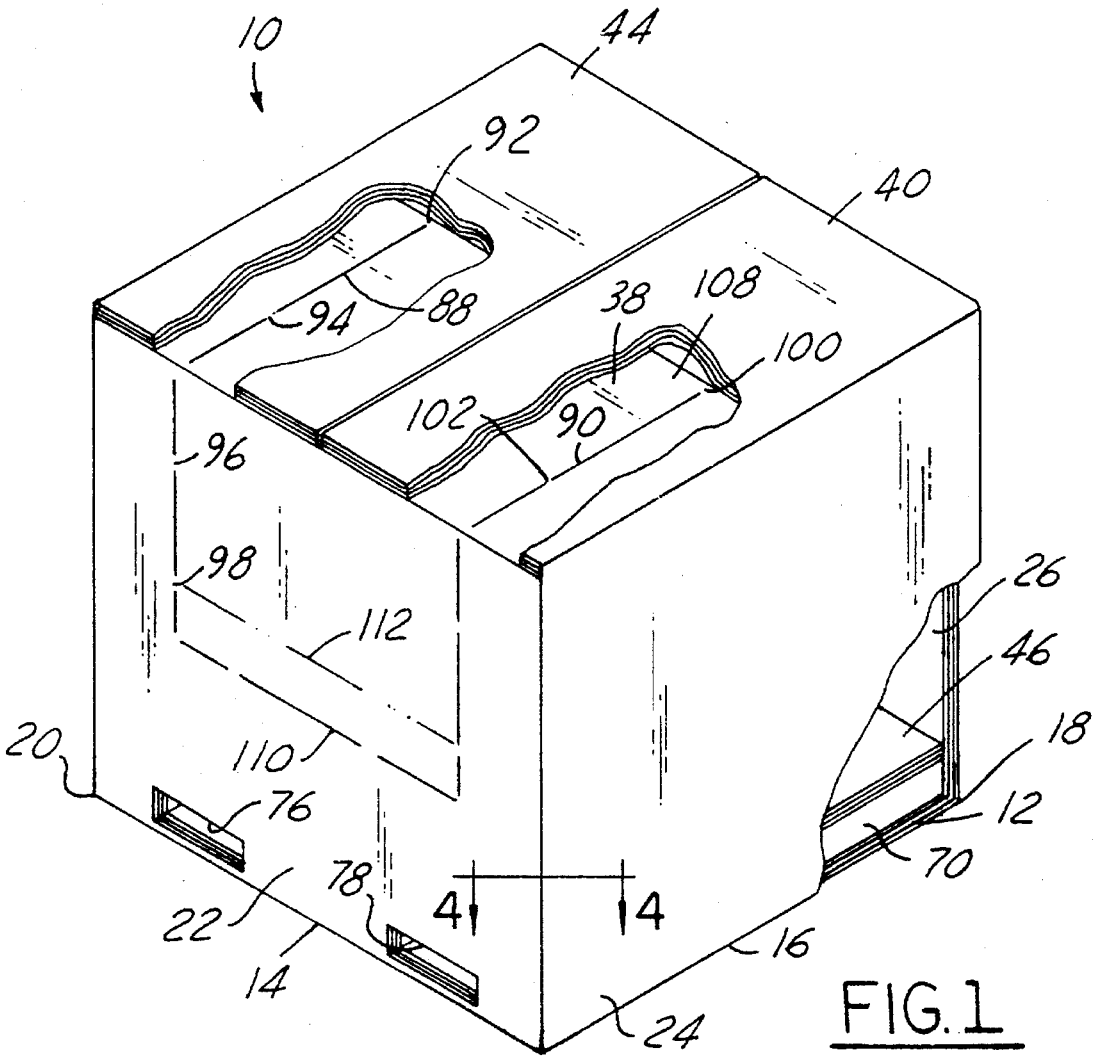
FIG. 1 is a view in perspective of one embodiment of the shipping container of the present invention with portions broken away for the purpose of clarity.
Figure 2:
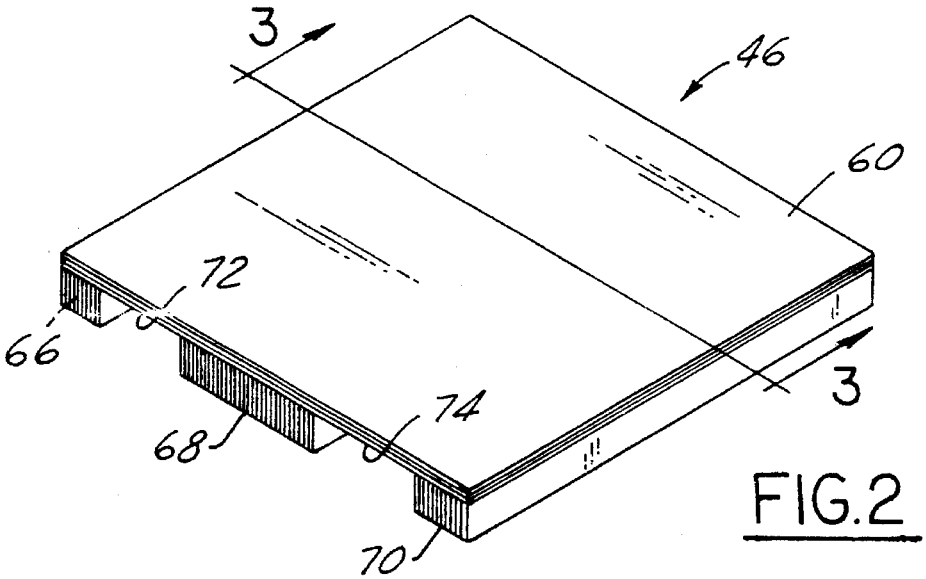
FIG. 2 is a view in perspective of a pallet provided within the container of FIG. 1.
Figure 3:
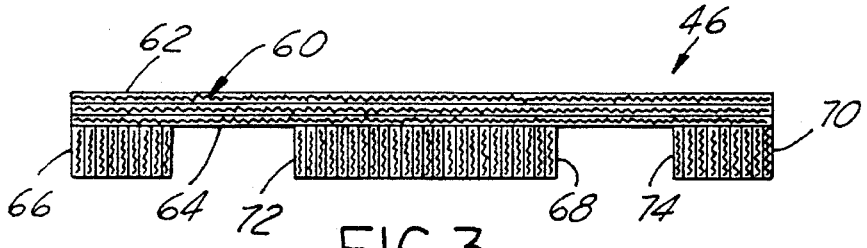
FIG. 3 is a sectional view taken substantially along the line 3—3 of FIG. 2 looking in the direction of the arrows.
Figure 5:
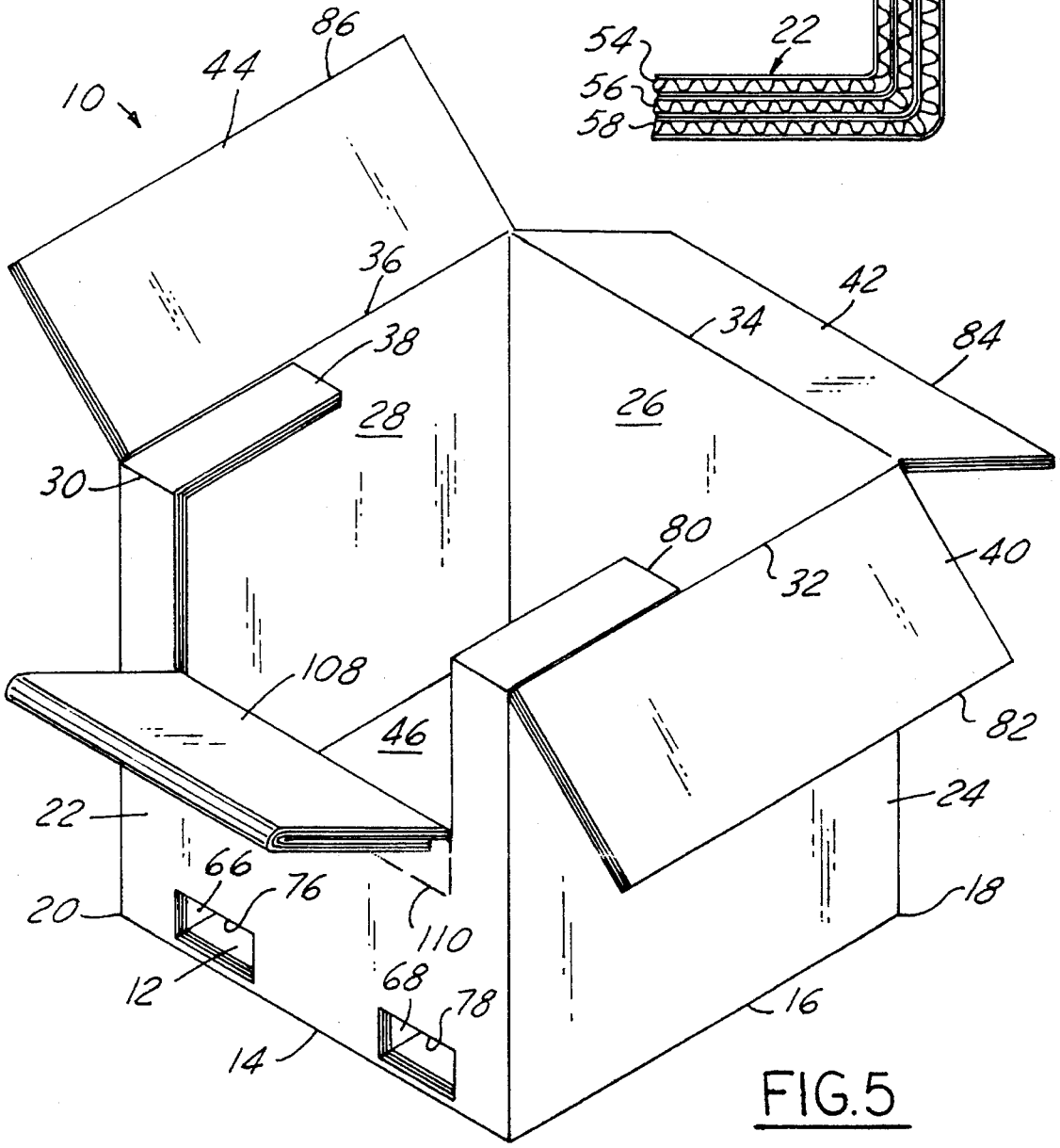
FIG. 5 is a view in perspective illustrating the container in the open position with a portion of one side wall and flap separated from the remaining portions of the side wall and flap.
Figure 6:
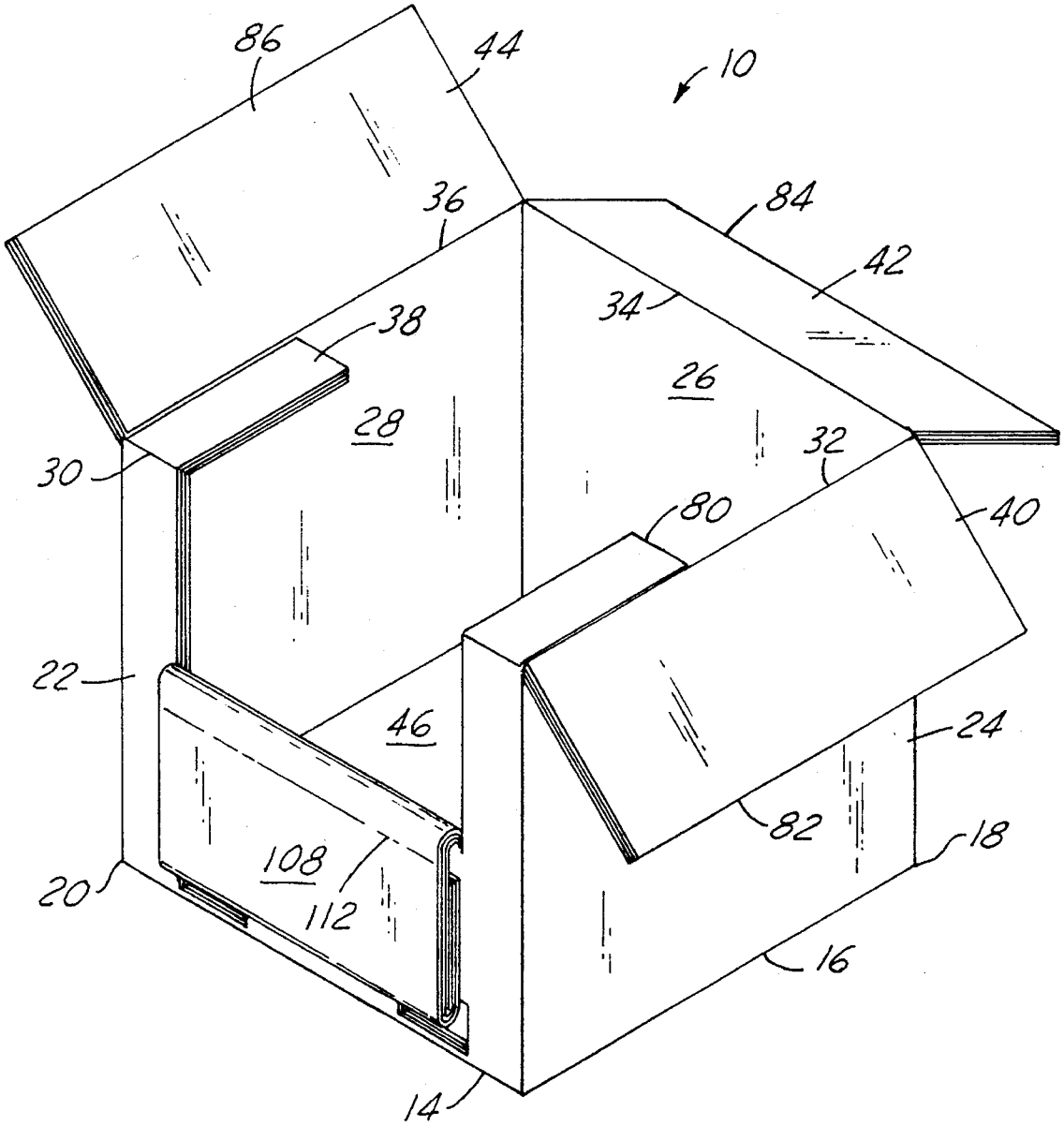
FIG. 6 is a view in perspective illustrating the container of FIG. 5 with an additional portion of the side wall separated from the remaining portions of the side wall.

Referring to FIGS. 1, 5 and 6, it will be noted that the shipping container 10 of the present invention comprises a generally rectangular bottom wall 12 having four edges 14, 16, 18, 20. A side wall 22, 24, 26, 28 extends upwardly from each edge 14, 16, 18, 20. Adjacent ones of the side walls 22, 24, 26, 28 are connected to each other.

Each side wall 22, 24, 26, 28 has an upper edge 30, 32, 34, 36. A closure flap 38, 40, 42, 44 is hingedly connected to the upper edge 30, 32, 34, 36 of each side wall. The flaps are foldable inwardly of the container 10 to form a top closure therefor, as shown in FIG. 1 and, as illustrated in FIG. 5, the flaps are foldable outwardly of the container 10 to permit access to the container interior.

Figure 4:
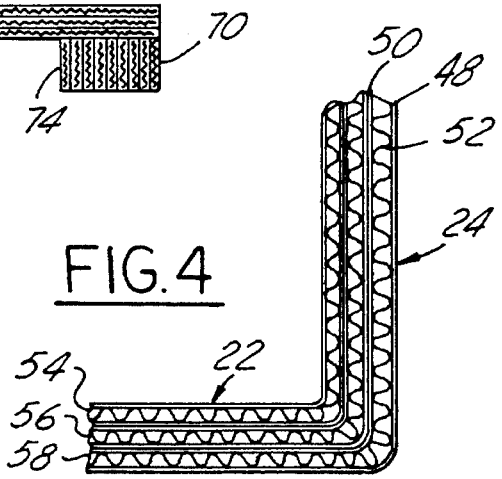
FIG. 4 is a sectional view taken substantially along the line 4—4 of FIG. 1 looking in the direction of the arrows.

A pallet 46 is provided within the container 10 supported by the bottom wall 12. The entire container 10 and the entire pallet 46 are fabricated of multi-ply corrugated cardboard, preferably triple-ply corrugated cardboard as illustrated in FIG. 4. Corrugated cardboard comprises a sandwich structure including outer flat cardboard panels 48, 50 which are adhered to a central undulating cardboard structure 52. As will be noted in FIG. 4, three such plys 54, 56, 58 are adhered together to form an overall sandwich structure which is characterized as being triple-ply. Triple-ply cardboard has substantially greater strength characteristics than does conventional single-ply material.

The pallet 46 includes an article carrying panel 60 having an upper surface 62 for supporting articles received in the container (the articles may be, for example, various parts or components used in manufacturing or assembly processes). The shipping container 10 may be filled with such articles and shipped from a manufacturing facility to an assembly facility for use. In one embodiment, a shipping container constructed in accordance with the present invention was capable of a load of 1,100 pounds.

The article carrying panel 60 has a lower surface 64 having at least three spaced-apart elongated support members 66, 68, 70 secured thereto as by an adhesive. The support members 66, 68, 70 extend entirely across the article carrying panel 60. The support members space the article carrying panel 60 from the bottom wall 12. The support members define a pair of elongated slots 72, 74 which are adapted to receive the tines of a forklift truck for lifting the pallet along with the shipping container 10 and any articles which are loaded therein. The pallet 46 is preferably adhered to the bottom portion of the container by means of gluing the support members 66, 68, 70 to the bottom wall 12 and marginal edge portions of the side walls 22, 24, 26, 28. Each elongated support member 66, 68, 70 comprises a plurality of triple-ply strips of corrugated cardboard adhered together and to the lower surface 64 of the article carrying panel 60. At least one of the container side walls 22 has a pair of spaced-apart openings 76, 78 therein adjacent the bottom wall 12 in alignment with the elongated slots 72, 74 to permit insertion of the tines of a forklift truck into the pallet slots 72, 74.

Each of the closure flaps 38, 40, 42, 44 has an unattached edge 80, 82, 84, 86. At least one of the side walls 22 and its hingedly connected flap 38 have a pair of spaced-apart discontinuous slits 88, 90 formed therein and extending from the unattached edge 80 of the flap 38 to a point substantially midway of the side wall 22 to which the flap 38 is connected. The discontinuity of the slits is created by spaced-apart unslitted tab portions 92, 94, 96, 98 and 100, 102, 104, 106 which are provided along the length of each slit 88, 90. The corrugated cardboard portion 108 of the side wall 22 and flap 38 between the slits 88, 90 is manually separable from the remaining portions of the respective side wall 22 and closure flap 38 by pulling down thereon to tear the tab portions and thereby permit ready access to the articles in the lower portion of the container. It will be appreciated that the containers are normally quite large. After the flaps have been open and the articles in the upper portion of the container are removed, it becomes quite difficult to lean over the top of the containers to reach the articles in the lower portion of the container. Therefor, when the portion 108 is separated from the remaining portions of the side wall 22 and closure flap 38, a person can bend over and reach the bottom of the container quite easily.

The side wall 22 having the slits 88, 90 is provided with score lines 110, 112 in two places between the slits 88, 90. A score is a groove-like indentation formed in the corrugated cardboard without actually slitting the material. The scores act as hinges to facilitate bending of the corrugated cardboard as needed. One of the scores 110 extends between the lower end points of the slits 88, 90 and the other score 112 extends between the slits 88, 90 at a position spaced upwardly therefrom. The scores facilitate manual downward bending of any corrugated cardboard portion which is separated from the remaining portions of the respective side wall 22 and closure flap 38 to get these portions out of the way and facilitate access to the container interior. The higher score line 112 is used when the person emptying the container 10 is relatively tall as illustrated in FIG. 5. The other score 110 is utilized for a shorter person as shown in FIG. 6.

What is claimed is:

1. In a shipping container comprising a generally rectangular bottom wall having four edges, a side wall extending upwardly from each edge, adjacent ones of the side walls being connected to each other, each side wall having an upper edge, a closure flap hingedly connected to the upper edge of each side wall, the flaps being foldable inwardly of the container to form a top closure therefore and foldable outwardly of the container to permit access to the container interior, the improvement comprising:

providing a pallet within the container supported by the bottom wall of the container, the pallet including an article carrying panel having an upper surface for supporting articles received in the container and a lower surface, the lower surface having at least three spaced apart elongated support members secured thereto and extending thereacross to thereby space the article carrying panel from the bottom wall, the support members defining a pair of elongated slots adapted to receive the tines of a fork lift truck for lifting the pallet, at least one of the container side walls having a pair of spaced apart openings therein adjacent the bottom wall in alignment with the elongated slots to permit insertion of said tines into the pallet slots, the entire container and the entire pallet being fabricated of multi-ply corrugated cardboard, each of the closure flaps having an unattached edge, at least one of the side walls and its hingedly connected flap having a pair of spaced apart discontinuous slits formed therein and extending from the unattached edge of the flap to a point substantially midway of the side wall to which the flap is connected, the discontinuity of the slits being created by spaced apart unslitted tab portions provided along the length of each slit, the corrugated cardboard portion between the slits being manually separable from the remaining portions of the respective side wall and closure flap by pulling thereon to tear the tab portions and thereby permit ready access to the articles in the lower portion of the container, wherein the side wall having the slits is provided with scores in at least two places between the slits, one of the scores extending between the lower end points of the slits and another of the scores extending between the slits at a position spaced upwardly therefrom, the scores facilitating manual downward bending of any corrugated cardboard portion which is separated from the remaining portions of the respective side wall and closure flap to get it out of the way and facilitate access to the container interior, at least two scores being provided to accommodate people of different heights.

2. A shipping container as defined in claim 1, wherein the pallet is adhered to the bottom portion of the container.

3. A shipping container as defined in claim 1, wherein the corrugated cardboard is triple-ply.

4. A shipping container as defined in claim 1, wherein each elongated support member comprises a plurality of strips of corrugated cardboard adhered together and to the lower surface of the article carrying panel.

* * * * *